US005363772A

United States Patent [19]

Adamidis

[11] Patent Number: 5,363,772

[45] Date of Patent: Nov. 15, 1994

[54] CENTER POST SUPPORTED TABLE WITH A MULTIPLE OF TABLE LEAVES

[76] Inventor: Ioannis J. Adamidis, 41 N. Adams Dr., Addison, Ill. 60101

[21] Appl. No.: 979,322

[22] Filed: Nov. 20, 1992

[51] Int. Cl.[5] ..... A47B 1/00

[52] U.S. Cl. ..... 108/66; 108/96

[58] Field of Search ..... 108/66, 65, 96, 150, 108/94, 95, 92, 106, 110, 144, 71, 76; 211/187, 107, 196

[56] References Cited

U.S. PATENT DOCUMENTS

| | | | |
|---|---|---|---|
| 351,101 | 10/1886 | Fauber | 108/66 |
| 2,162,298 | 6/1939 | Dailey | 108/66 |
| 2,515,661 | 7/1950 | Nitschke | 211/196 X |
| 2,675,924 | 4/1954 | Jegen | 108/96 |
| 3,538,863 | 11/1970 | Howard et al. | 100/107 X |
| 3,648,892 | 3/1972 | Morgan | 108/95 X |
| 3,765,541 | 10/1973 | Madey et al. . | |
| 4,044,448 | 8/1977 | Watanabe et al. . | |
| 4,103,853 | 8/1978 | Bannan | 211/107 X |
| 4,307,863 | 12/1981 | Patrigot . | |
| 4,381,714 | 5/1983 | Henneberg et al. . | |
| 4,382,642 | 5/1983 | Burdick . | |
| 4,440,096 | 4/1984 | Rice et al. . | |
| 4,763,582 | 8/1988 | Rigsby | 108/94 X |
| 4,782,764 | 11/1988 | Robinson | 108/150 X |
| 4,842,349 | 6/1989 | Stenemann . | |

FOREIGN PATENT DOCUMENTS

| | | | |
|---|---|---|---|
| 2627964 | 9/1989 | France | 108/150 |

*Primary Examiner*—Jose V. Chen
*Attorney, Agent, or Firm*—Charles F. Meroni, Jr.

[57] ABSTRACT

A combination table and rack structure selectively usable as a multi-level display rack and as a table. The structure comprises a base, a segmented table top having a plurality of leaves, an upright column fixedly mounted on the base, support arms beneath the leaves with each leaf attached to one of the support arms in an array surrounding the upright column. Adjustable connectors are positioned between each of the support arms and said upright column and being connectable at various vertical positions along a vertical axis of the upright column. The adjustable connectors enable the leaves to be adjustable so as to lie in a common horizontal plane at right angles to the vertical axis providing a uni-planar table top. The adjustable connectors also are selectively adjustable relative to one another to enable the leaves to be adjusted with at least some of the leaves being disposed in different horizontal planes relative to one another.

17 Claims, 4 Drawing Sheets

CENTER POST SUPPORTED TABLE WITH A MULTIPLE OF TABLE LEAVES

BACKGROUND OF THE INVENTION

The present invention relates to a combination table and rack structure where the structure or piece of furniture can be selectively used either as a rack or as a table for the display of articles such as jewelry and the like.

The combination table and rack structure includes an upright column that is mounted on a base and has a segmented table top mounted on the column. The segments of the table top each comprise a radial segment and may be of any suitable number. The shape of the segment can also be varied so that the table top may have a number of different configurations. One of the preferred configurations would be to make the table top circular. It is also contemplated that the table top could be shaped in many other shapes such as in the shape of an airplane or the shape of the front end of an airplane with one or more segments being configurated to simulate a propeller and the like.

According to my invention, when the combination or piece of furniture is to be used as a table, then all of the segments are positioned in a common plane and the segments are side-by-side engaged about the column collectively co-acting with the column to provide a table.

Where the combination or piece of furniture is to be used as a rack, then the segments can be positioned in different axial relationships relative to the column and be supported radially outwardly of the column. When the segments are oriented so as to use the combination or piece of furniture and the rack, my invention enables the segments or leaves to be positioned in a wide variety of relationships relative to the column and to each other so that articles can be attractively displayed on my rack.

It will further be seen that the structural features of my combination or piece of furniture are such that enable the structure to be conveniently and quickly converted from being a table to being a rack and vice versa merely by adjusting the connectors that connect segments or leaves to the post in varied orientations as may be required with a minimum amount of time being required to complete the adjustment.

SUMMARY OF INVENTION

A combination table and rack structure selectively usable as a multi-level display rack and as a table. The structure comprises a base, a segmented table top having a plurality of leaves, an upright column fixedly mounted on the base, support arms beneath the leaves with each leaf attached to one of the support arms in an array surrounding the upright column. Adjustable connector means being positioned between each of the support arms and said upright column and being connectable at various vertical positions along a vertical axis of the upright column. The adjustable connector means enable the leaves to be adjustable so as to lie in a common horizontal plane at right angles to the vertical axis providing a uni-planar table top. The adjustable connector means also being selectively adjustable relative to one another to enable the leaves to be adjusted with at least some of the leaves being disposed in different horizontal planes relative to one another.

According to other features of my invention I have provided the upright column with a center section secured thereto and mounted in a horizontal plane co-planar with the leaves when the leaves are selectively positioned to act as a table.

Yet other features of my invention relate to the center section being circular in shape.

Still further in features of my invention relate to each leaf having an arcuate inner edge having a radius common to the circular center section for engagement about a circumference of the center section.

Other and still further features of my invention relate to each of the support arms being L-shaped with opposite ends of legs of the L being permanently secured to and underside of an associated one of the leaves and at an opposite end of the L by the adjustable connecting means to the upright column.

Yet a still further feature of my invention relates to hooks being mounted on an underside of the leaves for suspending articles.

Another interesting feature of my invention relates to the leaves being circularly mounted about the upright column and have different shapes relative to one another, the different shapes when oriented and positioned to comprise the table when radially inner edges of the leaves are adjusted into contact with a radially outer surface carried on the upright column are such as to shape the leaves like an airplane.

My invention may also be expressed in still another way since it also relates to a combination table and rack structure that is selectively usable as a multi-level display rack and as a table. This combination comprises a base, a segmented table top having a plurality of radially extending side-by-side disposed leaves engaged in edge to edge relation comprising the table, an upright column fixedly mounted on the base, support arms with each leaf attached to one of the support arms in an array surrounding said upright column, and adjustable connecting means between each of the leaves and the support arms and the upright column and being connectable at various vertical positions along a vertical axis of the upright column to enable the leaves to be positioned in a variety of different horizontal planes in radially and axially spaced relation about the upright column.

DESCRIPTION OF THE PREFERRED EMBODIMENT

Figure 1:
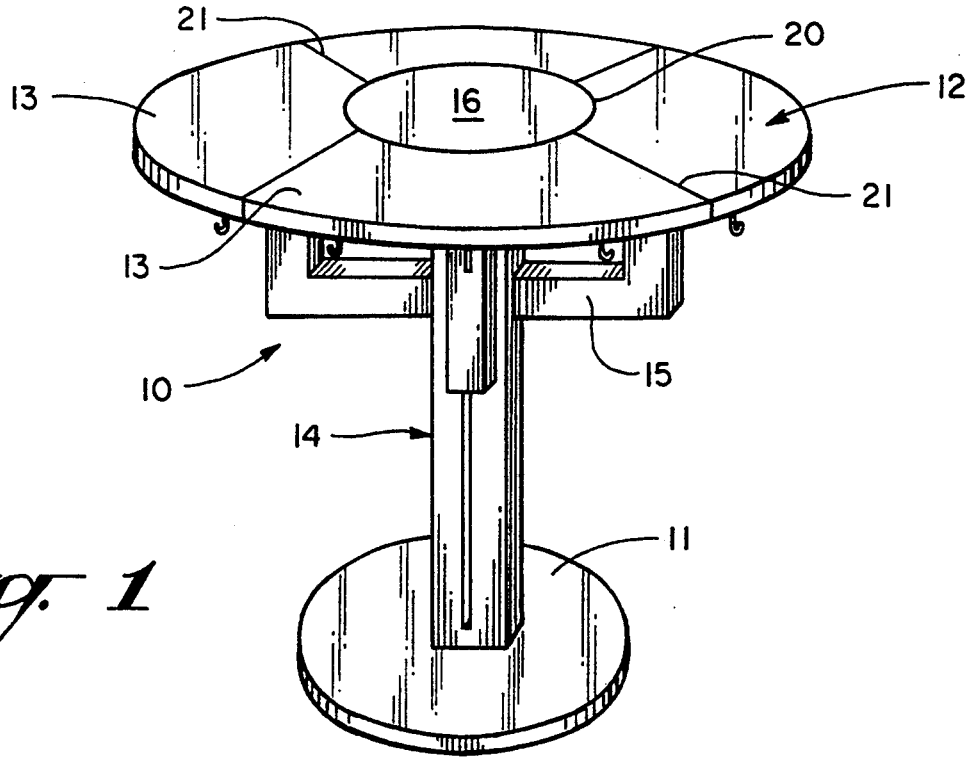
FIG. 1 is a perspective view of my combination table and rack structure.
Figure 2:
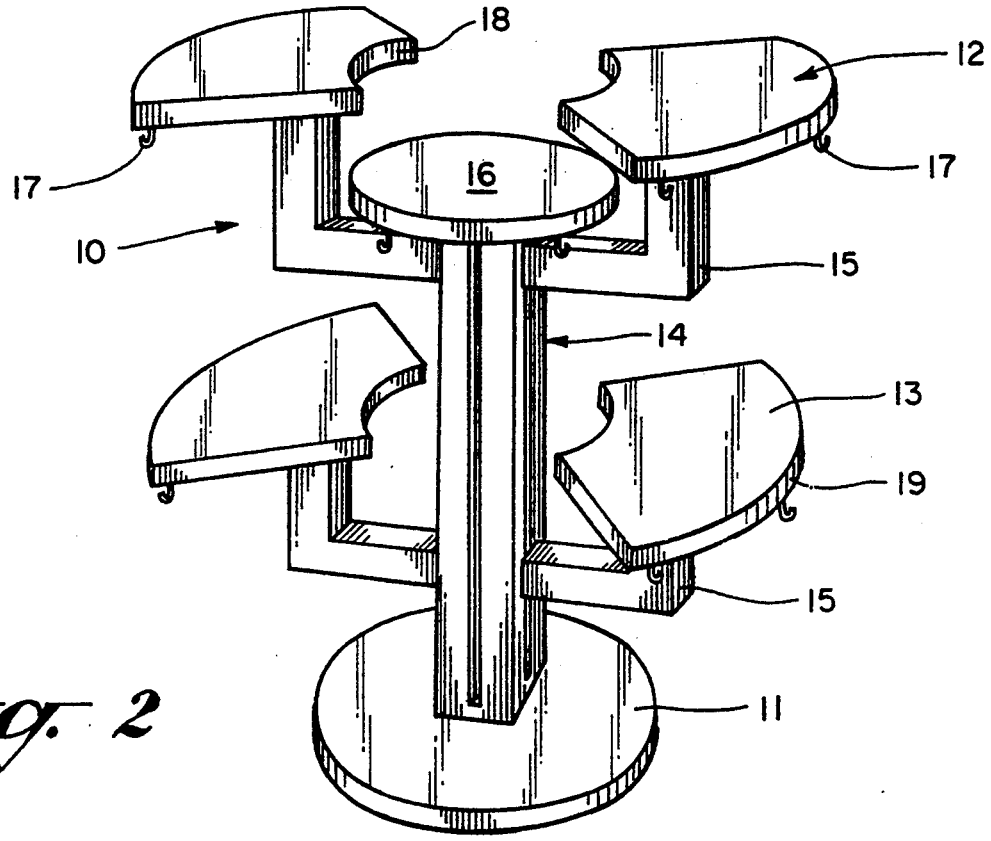
FIG. 2 is a perspective view similar to FIG. 1 except the combination is shown in an adjusted position as a rack structure.
Figure 3:
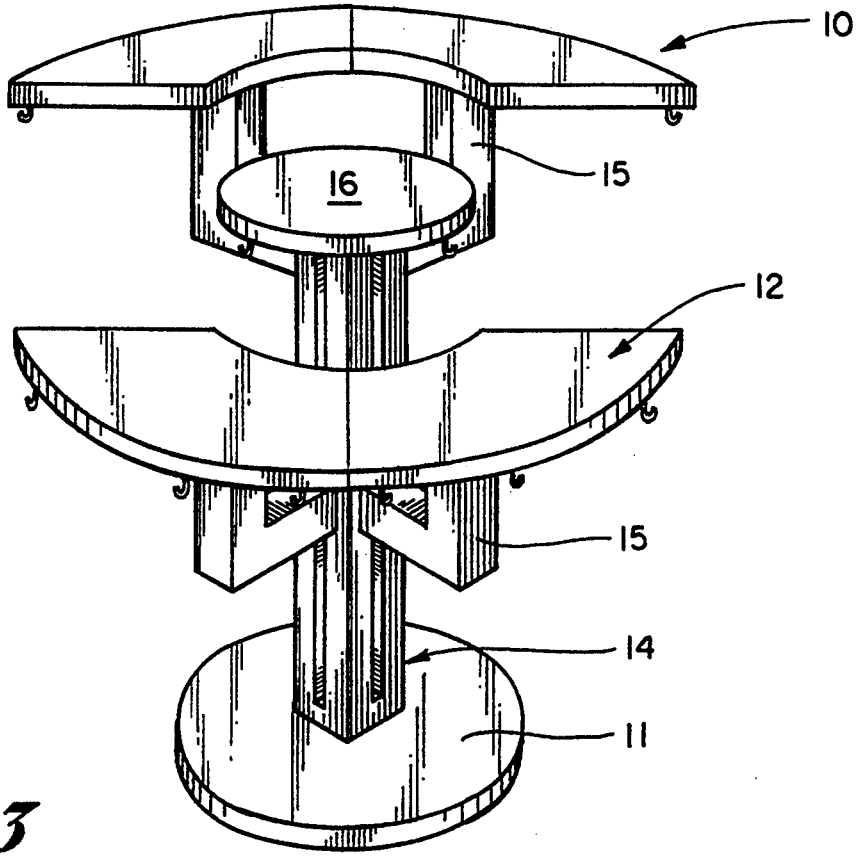
FIG. 3 is a perspective view similar to FIG. 2 only with leaves of the display rack oriented in a different way than the leaves shown in FIG. 4.
Figure 4:
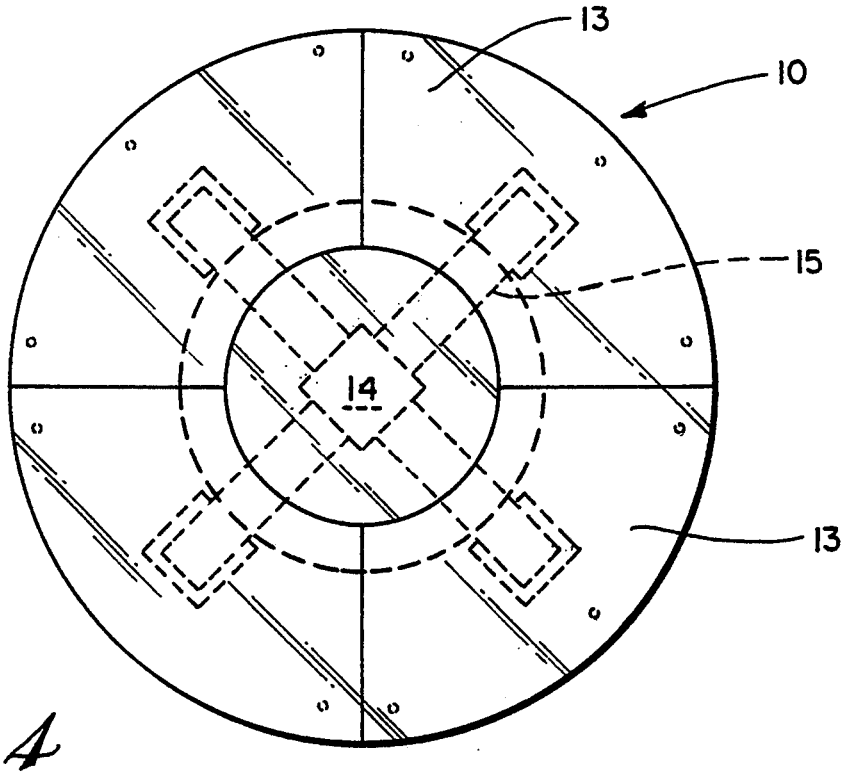
FIG. 4 is a top plan view of the combination table and rack structure shown in FIG. 1.
Figure 5:
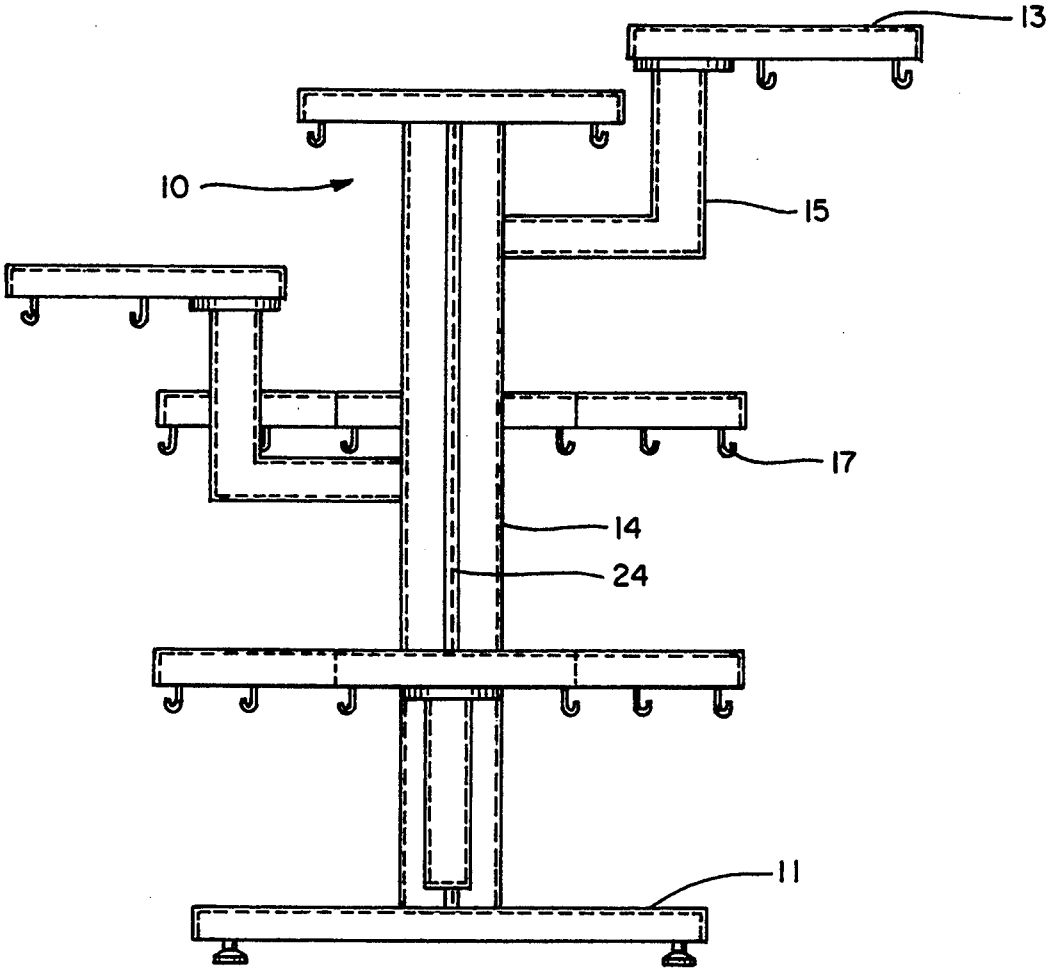
FIG. 5 is a side elevation of the combination table and rack structure showing the leaves mounted in still another arrangement.

According to my invention, I have provided a combination table and rack structure 10 which can be selectively used as a multi-level display rack as shown in FIG. 2 or as a table as shown in FIG. 1. The combination table and rack structure 10 comprises a base 11 and a segmented table 12. The table 12 has a plurality of leaves 13. An upright column 14 is fixedly mounted on the base 11. L-shaped support arms 15 are positioned beneath the leaves 13 and each leaf is attached to one of the support arms 15 in an array surrounding the upright column 14.

The column 14 is of a parallel sided or square cross sectional shape, and has an upper end carrying a circular central table or top section 16. The top section 16 forms a part of the table 12 when the leaves 13 and the central table or top section 16 are disposed in a common horizontal plane as seen in FIG. 1. A series of hooks 17 are suspended from an underside of the section 16 and the leaves 17 to enable articles to be carried on the underside of these components.

Figure 6:
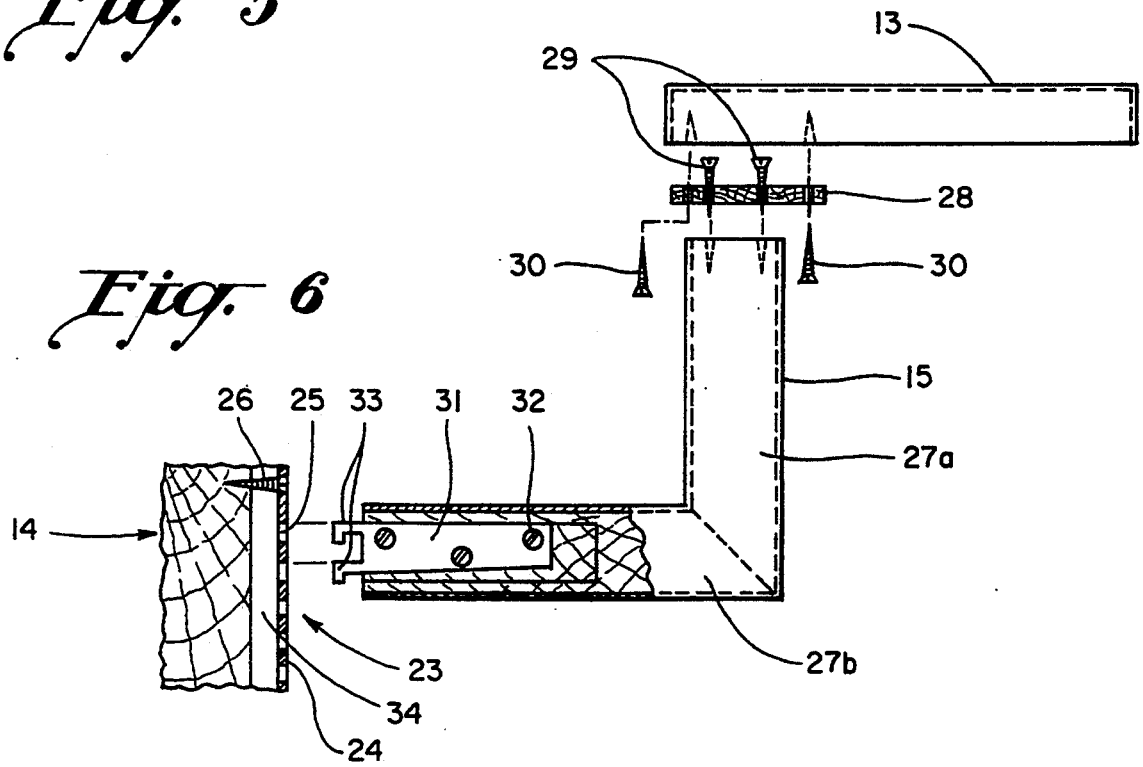
FIG. 6 is an exploded view showing the way in which the support arm can be attached to an upright column at one end and to a leaf at an opposite end.
Figure 7:
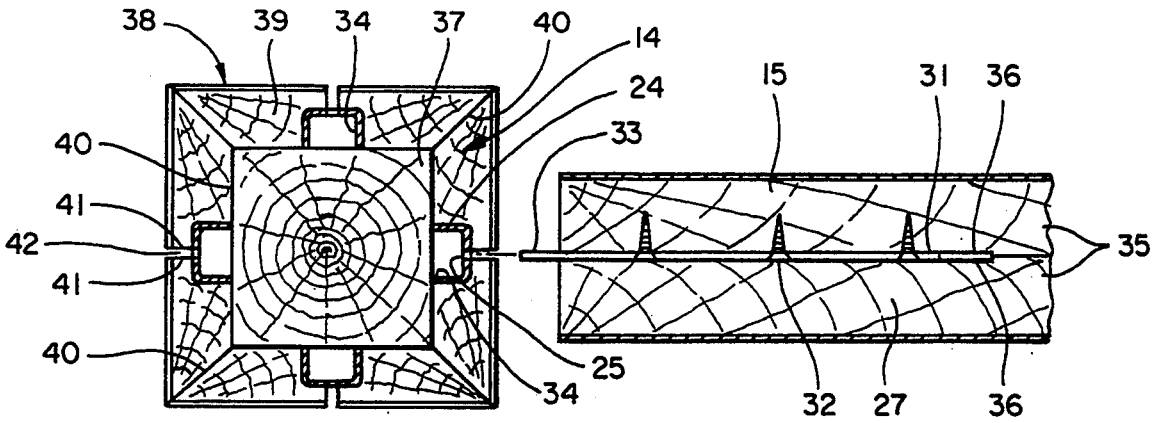
FIG. 7 is a partially cross sectional view of the structure shown in FIG. 6 showing the manner in which my support arm can be attached to the upright column.
Figure 8:
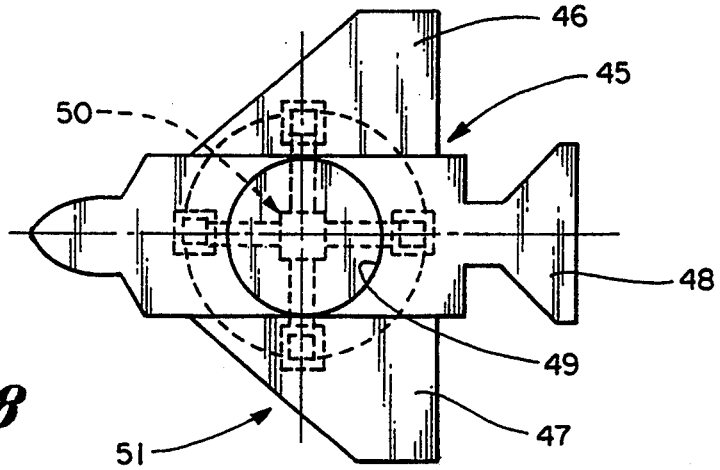
FIG. 8 is a modified view of an alternate form of my combination table and rack structure wherein the leaves are shaped in the form of an airplane when viewed from a top side of the combination table and rack structure.

The upright column 14 can be suitably attached to the base 11 and to the central table or top section 16 by suitable fasteners as are well-known in the art. These fasteners may vary depending on depending on the nature of the material used to form the combination table and rack structure 10. This structure can be formed from wood as seen in FIG. 6, or from a plastic or coated material which is used to cover the wood also as seen in FIG. 7. Similarily, the combination table and rack structure could also be formed from other materials such as a suitable synthetic plastic material or from a marble type material among other possibilities.

It will be seen that each of the leaves has an arcuate inner edge 18, and an arcuate outer edge 19. The outer edges 19 of the leaves 13 co-act together when the structure 10 is used as a table by providing a continuous annular outer surface. The arcuate inner edges 18 of the leaves 13 also co-act when they are disposed in a common horizontal plane to engage with an outer circumference 20 of the circular central table or top section 16. When the leaves 13 are positioned for use as a segmented table 12, side edges 21—21 co-act and are engaged in abutment with side edges of contiguous adjacent leaves 13.

It will be also observed in FIG. 2 that the leaves 13 can be positioned in relative horizontal planes relative to one another and relative to the circular central table or top section 16 so that conceivably all four of the leaves could be 14 in different planes along with the circular central table or top section 16. If the structure is to be used as a display rack as shown in FIG. 2, then articles could be mounted on the different leaves to provide a decorative display.

Now in order to enable the arms 15 which support the leaves 13 in view of connections therebetween as shown in FIG. 6, the L-shaped arms 15 are also adapted to be secured to the post 14 by adjustable connecting means 23 as indicated at 23 in FIG. 6 where the components of the means are illustrated in an exploded position. To this end, the post 14 is provided with a vertically extending channel metallic strip 24 with the slots being indicated at 25. This strip 24 can be secured to the post 14 by suitable fasteners 26 which extend through one or more of the slots 25.

Each of the L-shaped support arms has an upright leg **27*a* and a horizontal leg 27*b*. A mounting plate 28 is provided at an upper end of the upright support leg and is secured by means of suitable fasteners such as screws 29,29 to an upwardly facing upper end of the upright leg 27*a*. A second set of fasteners 30—30 are screwed through the plate 28 into the associated leaf 13 to secure the leaf to the upright leg 27*a* of the L-shaped arm 15**.

The adjustable connecting means 23 further includes a hook-shaped bracket 31 which are secured by fasteners or screws 32 inside slots provided in the horizontal leg **27*b* of the L-shaped support arm 15**.

The bracket 31 is provided with a pair of hooks 33,33 at one end of the bracket which are spaced apart a distance such that they can easily fit into the slots 25 on the metal strip 24 for attaching the arms to the upright column or post 14. This relationship is clearly shown in FIG. 6. It will further be seen in FIG. 7 that the strips 24 are each channel shaped and provide an interior channel 34 where the hooks 33,33 can be lodged so as to be insertable in the slots 25 without interference from the upright column or post 14.

To facilitate in the construction of the support arms 15, the arms 15 are comprised of a pair of arm pieces 35,35 which have slotted areas 36,36 for receipt of the hook-shaped bracket 31 when the arm pieces 35,35 are secured by suitable means in side-by-side confronting relationship as shown in FIG. 7.

Now the post 14 is also of a composite multi-part construction to facilitate the attachment of the channel shaped strips 24 to the upright post or column.

In order to secure the interior channels 34 to the upright column 14 FIG. 7 shows one way for achieving this result. To this end, the upright column has a central wooden post-like member 37. Mounted about the perimeter of the parallel sided center post 37 are four of the channels 34. The channels are held to the center post 37 by means of an annular collar 38 that is comprised of eight separate pieces 39 or segments which can be formed of any suitable material such as wood or like and which have angle cut corner ends 40. Glue can be provided at the joints which glue is indicated generally by the number 40. When the pieces 39 are formed they are cut in such a way that when they are mounted on the center post 37 ends 41 of the pieces 39 are left in spaced relationship to provide a gap or vertical slot 42 for receipt of the hooks 33,33 provided on the one end of the hook-shaped bracket 31 (FIG. 7). The slot 42 is positioned so that it is in radial confrontation with strip slot 25 in the channel shaped metallic strip 24.

A modified combination table and rack structure 45 which is very much like the one previously identified at 12 as previously described in full detail except that leaves 46, 47, and 48 when mounted on an upper center table or top section 49 (like Section 16) of a center post or column 50 provides a table top 51 that when viewed from the top has the shape of an airplane. In this instance, the three leaves 46, 47, and 48 are only three in number as compared to the combination table and rack structure 10. The leaves 46, 47, and 48 can be mounted at different levels relative to one another to provide a rack structure as previously described. The same adjustable connecting means of the type previously described and indicated at 23 can be used to secure the leaves 46, 47, and 48 in position on the center post which corresponds to the post 16 in the first embodiment. Also, the leaves are not all of the same configuration which is a feature that further differs from the combination table and rack structure 10 and its leaves 13. Here a center post like 14 carries the integral circular central table or top section 49 in the same way as previously described.

Figure 9:
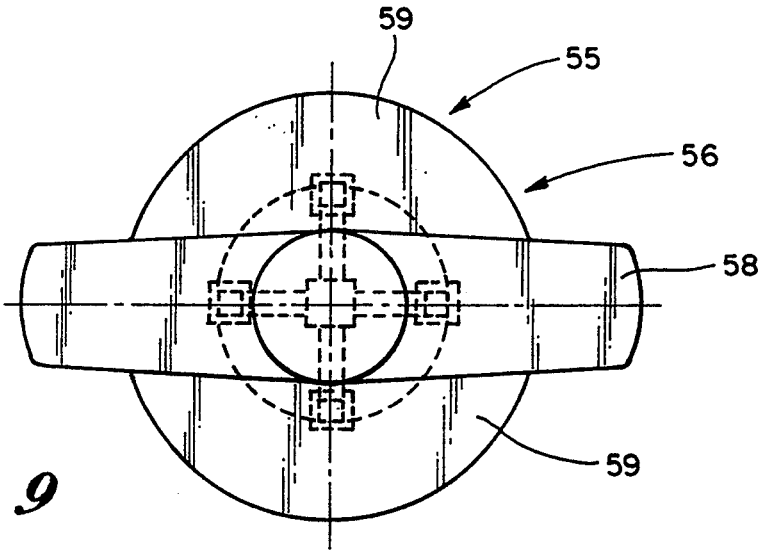
FIG. 9 is still another modified view of a further form of a combination table and rack structure where the leaves are differently configurated than those shown in FIGS. 1 and 8.

Turning now to FIG. 9, it will be seen there that I have provided a combination table and rack structure 55. In this instance, the table and rack structure has an upper table 56 and it is shown in plan view in FIG. 9. The table 56 is comprised of a series of leaves 57,57 and 58. These leaves 57,57 and 58 can be positioned in a common horizontal plane to permit the combination table and rack structure to act as a table. The leaves 57,57 are of an identical configuration while the leaf 58 is positioned between the leaves 57,57 and has a propeller simulated shape. Mounted interiorally of the upper table 56 is a central table or top section 59 which is similar to the section 16 as previously described. This section is also carried on a post similar to the one shown at 14 in FIG. 1. Also, since this embodiment of my invention 55 also contemplates using adjustable connecting means of the type previously described and indicated at 23, it is also possible for the combination table and rack structure to act as a rack where the individual leaves 57,57 and 58 are mounted at different levels for horizontal positions relative to one another for providing a series of shelves or supports to enable articles to be displayed on the rack structure.

The combination table and rack structure can have other shapes than those illustrated in my patent drawings. As an example, the element 16 can either be parallel sided as a square or it can be octagonally or hexagonally shaped, as may be desired. Where the center section 16 has such a different shape, then the leaves 13 will also be modified in shape so that its radially inner edge of each leaf will match with a surface of the center section 16 enabling the leaves and the center section to provide a closed table surface similar to the table shown in FIG. 10. It is also contemplated that the center section could be in an eliptical shape in which event the leaves would have a radially inner surface that would collectively match the peripheral surface of the elipse when the inner leaf surfaces were engaged with the outer surface of the eliptical center section to provide a closed table similar to that shown in FIG. 1. In all of these modified forms here discussed, the leaves would be mounted on supporting arms and be adapted to be moved vertically into varying adjusted positions, some of which positions are illustrated in the drawings that are attached herewith.

As described above, the combination table and rack structure 10 of the present invention provides a number of advantages, some of which have been described above and others of which are inherent in the invention.

Also, modifications may be proposed to the device 10 without departing from the teachings herein.

I claim:

1. A combination table and rack structure selectively usable as a multi-level display rack and as a table comprising a base, a segmented table top having a plurality of leaves, an upright column fixedly mounted on the base, support arms with each leaf attached to one of said support arms in an array surrounding said upright column, and adjustable connecting means between each of said leaves and said support arms and said upright column and being selectively connected at anyone of various vertical positions along a vertical axis of said upright column, said adjustable connecting means enabling said leaves to be adjustable so as to lie in a common horizontal plane at right angles to said vertical axis providing a uni-planar table top, said adjustable connecting means also being selectively adjustable relative to one another to enable said leaves to be adjusted with at least some of said leaves being disposed in different horizontal planes relative to one another, the upright column has a center section secured thereto and mounted in a horizontal plane co-planar with the leaves when the leaves are selectively positioned to act as a table, said center section is circular in shape and said leaves being engaged about an outer circumference of said circular center section.

2. The combination table and rack structure of claim 1 wherein each leaf has an arcuate inner edge having a radius common to said circular center section, said leaves each having generally radially extending side edges butt engaged with the side edges of adjacent ones of said leaves with said leaves acting together providing said segmented table top.

3. The combination table and rack structure of claim 1 wherein each of said support arms are L-shaped, and means so provided which permanently secures opposite ends of legs of the L to underside of an associated one of said leaves and at an opposite end of said L by said adjustable connecting means to said upright column.

4. The combination table and rack structure of claim 1 wherein said leaves are circularly mounted about said upright column and have different shapes relative to one another.

5. The combination table and rack structure of claim 4 wherein the different shapes when oriented and positioned to comprise the table when radially inner edges of said leaves are adjusted into contact with a radially outer surface carried on said upright column are such as to shape the leaves like an airplane propeller.

6. The combination table and rack structure of claim 4 wherein the different shapes when oriented and positioned to comprise the table when radially inner edges of said leaves area adjusted into contact with a radially outer surface carried on said upright column are such as to shape the leaves like a propeller.

7. The combination table and rack structure of claim 1 wherein said leaves are circularly mounted about said upright column and have the same shape relative to one another.

8. The furniture of claim 1 wherein the different shapes are such as to shape the leaves like an airplane.

9. A furniture selectively usable as a multi-level display rack and table comprising a base, a segmented table top having a plurality of leaves, an upright column fixedly mounted on the base, support arms beneath said leaves with each leaf attached to one of said support arms in an array surrounding said upright column, and adjustable connecting means between each of said support arms and said upright column and being selectively connected at anyone of various vertical positions along a vertical axis of said upright column, said adjustable connecting means enabling said leaves to be adjustable so as to lie in a common horizontal plane at right angles to said vertical axis providing a uni-planar table top, said adjustable connecting means also being selectively adjustable relative to one another to enable said leaves to be adjusted with at least some of said leaves being disposed in different horizontal planes relative to one another, the upright column has a center section secured thereto and mounted in a horizontal plane co-planar with the leaves when the leaves are selectively positioned to act as a table, wherein said center section is circular in shape, each leaf has an arcuate inner edge having a radius common to said circular center section for engagement about a circumference of said center section.

10. The combination table and rack structure of claim 9 wherein each of said support arms are L-shaped, and means so provided which permanently secures opposite ends of legs of the L to underside of an associated one of said leaves and at an opposite end of said L by said adjustable connecting means to said upright column.

11. The furniture of claim 9 wherein at least one of said leaves is adjustable so as to be positioned in a horizontal plane located above an upper end of said upright column.

12. The furniture of claim 9 wherein some of said leaves are positioned beneath an upper end of said column and other of said leaves are positioned above an upper end of said column.

13. The furniture of claim 9 wherein said leaves are axially and circumferentially staggered relative to one another for enabling articles to be displayed at different levels circumferentially about said upright column.

14. The furniture claim 9 wherein said leaves are provided with leaf hanger arms which are adjustably connected to said upright column in a uni-planar position or in variable positions relative to one another as determined by a user of the structure.

15. The furniture of claim 9 wherein said leaves are circularly mounted about said upright column and have different shapes relative to one another.

16. The furniture of claim 15 wherein the leaves are differently shaped and are shaped in the configuration that simulates a propeller.

17. The furniture of claim 9 wherein said leaves are circularly mounted about said upright column and have the same shape relative to one another.

* * * * *